US007180498B2

(12) United States Patent
Hiraki

(10) Patent No.: US 7,180,498 B2
(45) Date of Patent: Feb. 20, 2007

(54) DISPLAY DEVICE AND DISPLAY METHOD

(75) Inventor: Katsuyoshi Hiraki, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 94 days.

(21) Appl. No.: 10/097,695

(22) Filed: Mar. 13, 2002

(65) Prior Publication Data

US 2003/0038765 A1 Feb. 27, 2003

(30) Foreign Application Priority Data

Aug. 22, 2001 (JP) ..... 2001-251576

(51) Int. Cl.
*G09G 3/36* (2006.01)
*G09G 5/00* (2006.01)

(52) U.S. Cl. ..... 345/99; 345/94; 345/208

(58) Field of Classification Search ..... 345/87, 345/94, 95, 98–100, 103, 104, 204, 210, 345/213, 208

See application file for complete search history.

(56) References Cited

U.S. PATENT DOCUMENTS 5,192,945 A * 3/1993 Kusada ..... 345/88
5,856,816 A * 1/1999 Youn ..... 345/98
6,219,022 B1 * 4/2001 Yamazaki et al. ..... 345/103
6,331,844 B1 * 12/2001 Okumura et al. ..... 345/87
6,407,730 B1 * 6/2002 Hori ..... 345/100
6,529,181 B2 * 3/2003 Nakano et al. ..... 345/98
6,549,181 B2 * 4/2003 Sakai et al. ..... 345/74.1

* cited by examiner

*Primary Examiner*—Bipin Shalwala
*Assistant Examiner*—Jeff Piziali
(74) *Attorney, Agent, or Firm*—Greer, Burns & Crain, Ltd.

(57) ABSTRACT

There is provided a display device and method which is capable of securing the optimum operation thereof irrespective of an external clock signal. An input circuit receives image data input thereto. First to N-th (N≧2) storage circuits store image data input via the input circuit such that the image data is divided into respective N regions. First to M-th (M≧N) driving circuits drive respective regions M of at least part of the display block formed by dividing the at least part of the display block. An image data supply circuit reads out image data stored in each of the first to N-th storage circuits and supplies the image data to a corresponding one of the driving circuits. A clock signal generation circuit generates a clock signal for enabling image data to be read out from the first to N-th storage circuits and be supplied to the first to M-th driving circuits, in synchronism therewith.

30 Claims, 12 Drawing Sheets

DISPLAY DEVICE AND DISPLAY METHOD

BACKGROUND OF THE INVENTION (1) Field of the Invention

This invention relates to a display device and method, and more particularly to a display device and method for receiving and displaying image data on a display block.

(2) Description of the Related Art

In a display device, such as a liquid crystal display device, a method is sometimes employed in which one horizontal line on a liquid crystal panel is divided and scanned by a plurality of LCD (Liquid Crystal Display) drivers.

When scanning is performed by this method, it is required that transfer of image data to LCD drivers and scanning of one horizontal line on the liquid crystal panel are completed during one horizontal line period.

Recently, display devices have come to display an increasingly higher definition image. Accordingly, the amount of image data forming one horizontal line is ever increasing and one horizontal line period is also ever shortening. As a result, it has become necessary to complete transfer of image data to LCD drivers and scanning of one horizontal line in a short time period.

In line with the above recent trend, it is a conventional method employed for shortening a time period for transfer of image data to LCD drivers, to provide line memories for storing image data of one horizontal line and transfer portions of the image data therefrom to a plurality of LCD drivers, respectively, in a parallel fashion.

FIG. 6 shows an example of the construction of a liquid crystal display device based on the above method.

In the illustrated example, the liquid crystal display device is comprised of an I/F (Interface) 50, a control block 51, a left-side line memory 52, a right-side line memory 53, LCD drivers 56-1 to 56-6, and a liquid crystal panel 57.

The I/F 50 receives an image signal delivered, for instance, from a graphic accelerator, not shown, of a personal computer, not shown, extracts a CLK signal, horizontal and vertical synchronizing signals, and an image signal therefrom, and supplies these signals to the control block 51.

The control block 51 generates a driver control signal by dividing the frequency of the CLK signal by a factor of 2 to supply the driver control signal to the LCD drivers 56-1 to 56-6 and at the same time generates a left-side write enable signal and a right-side write enable signal from the horizontal and vertical synchronizing signals to supply these signals to the left-side line memory 52 and the right-side line memory 53, respectively. Further, the control block 51 supplies the image signal supplied from the I/F 50 in an amount corresponding to one horizontal line, to the left-side line memory 52 when the left-side write enable signal is active, and to the right-side line memory 53 when the right-side write enable signal is active.

The left-side line memory 52 stores image data which is supplied from the control block 51 and corresponds to a left half region of the one horizontal line.

The right-side line memory 53 stores image data which is supplied from the control block 51 and corresponds to a right half region of the one horizontal line.

The LCD drivers 56-1 to 56-3 cause image data supplied from the left-side line memory 52 to be displayed in the left half region of the one horizontal line on the liquid crystal panel 57.

The LCD drivers 56-4 to 56-6 cause image data supplied from the right-side line memory 53 to be displayed in the right half region of the one horizontal line on the liquid crystal panel 57.

The liquid crystal panel 57 displays an image corresponding to the image data supplied from the LCD drivers 56-1 to 56-6.

Next, the operation of the above conventional display device will be described.

Upon receiving the image signal, the I/F 50 extracts the CLK signal, the horizontal and vertical synchronizing signals, and the image signal therefrom, and supplies these signals to the control block 51.

The control block 51 generates the left-side write enable signal which becomes active for a left half region of one horizontal line, and the right-side write enable signal which becomes active for a right half region of the one horizontal line to supply the left-side and right-side write enable signals to the left-side line memory 52 and the right-side line memory 53, respectively.

Further, the control block 51 generates a driver control signal by dividing the frequency of the CLK signal by a factor of 2, and supplies the driver control signal to the LCD drivers 56-1 to 56-6.

Furthermore, the control block 51 supplies respective image signals as write data to the left-side line memory 52 and the right-side line memory 53.

The left-side line memory 52 reads in the write data for storage when the left-side write enable signal is active. As a result, image data corresponding to the left half region of the one horizontal line is stored in the left-side line memory 52.

On the other hand, the right-side line memory 53 reads in the write data for storage when the right-side write enable signal is active. As a result, image data corresponding to the right half region of the one horizontal line is stored in the right-side line memory 53.

It should be noted that since time periods during which the left-side and right-side write enable signals are active are identical, the same amount of image data is written in each of the left-side line memory 52 and the right-side line memory 53.

After storage of the image data in both of the left-side line memory 52 and the right-side line memory 53 has been completed, the left-side line memory 52 sequentially transfers the image data stored therein to the LCD drivers 56-1 to 56-3 in synchronism with a CLK signal (hereinafter referred to as "the frequency-divided clock signal") which is obtained by dividing the frequency of the CLK signal supplied from the control block 51 by a factor of 2. More specifically, the left-side line memory 52 transmits a first portion of the image data to the LCD driver 56-1, then a second portion of the same to the LCD driver 56-2, and finally the remaining portion to the LCD driver 56-3.

At this time, similarly to the left-side line memory 52, the right-side line memory 53 as well sequentially transfers the image data stored therein to the LCD drivers 56-4 to 56-6 in synchronism with the frequency-divided clock signal. More specifically, the right-side line memory 53 transmits a first portion of the image data to the LCD driver 56-4, then a second portion of the same to the LCD driver 56-5, and finally the remaining portion to the LCD driver 56-6.

After the whole image data has been transferred to the LCD drivers 56-1 to 56-6 as described above, the control block 51 sends a control signal to each of the LCD drivers 56-1 to 56-6 for causing them to sequentially output the transferred image data to the liquid crystal panel 57. Responsive to the control signal, the LCD drivers 56-1 to 56-6 sequentially outputs the image data to the liquid crystal panel 57, whereby the scanning of one horizontal line is completed.

The above processing is repeatedly carried out for each horizontal line, and after completion of display of image data for all the horizontal lines, the next frame starts to be drawn.

According to the method described hereinabove, image data of one horizontal line is divided into two portions such that they are stored in the left-side line memory 52 and the right-side line memory 53, respectively, and transferred to the LCD drivers 56-1 to 56-3 and the LCD drivers 56-4 to 56-6 sequentially in a parallel fashion. Hence, assuming that a time period required for transfer of image data to be supplied to each LCD driver is constant, it is possible to reduce the frequency of a clock signal used in the transfer of image data to a half.

Now, in the conventional display device shown in FIG. 6, the number of the LCD drivers 56-1 to 56-6 is even (=6), and the left and right half regions of each horizontal line on the liquid crystal panel 57 are driven by the LCD drivers 56-1 to 56-3 and the LCD drivers 56-4 to 56-6, respectively. Accordingly, the amount of image data stored in the left-side line memory 52 and that of image data stored in the right-side line memory 53 are equal to each other.

However, as shown in FIG. 7, when the liquid crystal panel 57 is driven by an odd number of LCD drivers 56-1 to 56-7, and if the amount of image data stored in the left-side line memory 52 and that of image data stored in the right-side line memory 53 are different from each other, a time period required for transferring image data from the left-side line memory 52 to the LCD drivers 56-1 to 56-4 is longer than a time period required for transferring image data from the right-side line memory 53 to the LCD drivers 56-5 to 56-7.

Now, this problem will be described based on an example. Let it be assumed that as shown in FIG. 8, the left half region of the liquid crystal panel 57 is driven by the LCD drivers 56-1 to 56-3 each of which has 6 outputs, while the right half region of the liquid crystal panel 57 is driven by the LCD drivers 56-4 to 56-6 each of which has 6 outputs similarly to the LCD drivers 56-1 to 56-3.

If one data item is needed to obtain one output, and one pulse of the clock signal is necessary for transfer one data item, 18 (=6×3) pulses of the frequency-divided clock signal are necessitated to transmit image data from the left-side line memory 52 to the LCD drivers 56-1 to 56-3. The same applies to a case in which image data is transferred from the right-side line memory 53 to the LCD drivers 56-4 to 56-6.

Next, a case illustrated in FIG. 9 will be considered in which the number of the LCD drivers 56-1 to 56-7 is odd. In this example, it is necessary to transfer image data from the left-side line memory 52 to the LCD drivers 56-1 to 56-4, and also image data from the right-side line memory 53 to the LCD drivers 56-5 to 56-7. Here, to transmit image data from the left-side line memory 52 to the LCD drivers 56-1 to 56-4, 24 (=6×4) pulses of the frequency-divided clock signal are necessary, while to transmit image data from the right-side line memory 53 to the LCD drivers 56-5 to 56-7, 18 (=6×3) pulses of the frequency-divided clock signal are necessary.

By the way, the frequency-divided clock signal is generated by dividing the frequency of the CLK signal delivered from the I/F 50 by a factor of 2, while the number of pulses of the CLK signal during one horizontal time period is set based on the number "42" (=6×7) of image data items which should form one horizontal line. If the number of pulses of the CLK signal during the one horizontal time period is equal to 42, the number of pulses of the frequency-divided clock signal which is formed by dividing the frequency of the CLK signal by a factor of 2, during the one horizontal time period becomes equal to "21" (=42÷2). Although this number of pulses is sufficient for 18 pulses necessary for transfer of image data from the right-side line memory 53 to the LCD drivers 56-5 to 56-7, it is not sufficient for 24 pulses necessary for transfer of image data from the left-side line memory 52 to the LCD drivers 56-1 to 56-4. As a result, in this case, the transfer of data to the left side of the liquid crystal panel 57 cannot be carried out in time.

Further, since LCD drivers are generally provided as semiconductor devices, the number of outputs thereof is usually predetermined. Therefore, if the number of outputs of a single LCD driver and the number of pixels of the liquid crystal panel 57 do not have the relationship of an integral multiple between them, LCD drivers sometimes have extra outputs which are a surplus as in a case illustrated in FIG. 10. In the illustrated example, the leftmost LCD driver 56-1 and the rightmost driver 56-6 each have two extra outputs.

Now, LCD drivers are each required to have a control signal input thereto after reading in data corresponding to the number of outputs thereof, so that as shown in FIG. 10, even when there are extra outputs among the LCD drivers, it is necessary to input data corresponding to the number of outputs which each LDC driver inherently has, to each LCD driver. In other words, even when an LCD driver has extra outputs, the LCD driver is required to be supplied with the same number of pulses of the clock signal as supplied when it has no extra outputs. Accordingly, in the illustrated example, 18 pulses of the clock signal are required although the number of image data items output to the liquid crystal panel 57 is 16 on each of the left and right sides of the liquid crystal panel 57.

Therefore, when the number of pulses of the CLK signal is set according to the number of pixels of one horizontal line on the liquid crystal panel 57, there sometimes occurs the same problem as described above.

Furthermore, as shown in FIG. 11, a signal (gate turn-ON signal: see FIG. 11(A)) by which each LCD driver turns on a gate of the liquid crystal panel 57, and a liquid crystal voltage-applying signal (see FIG. 11(B)) for writing image data in the liquid crystal panel 57 have the relationship shown in these figures between the same.

FIG. 12 is a diagram showing an equivalent circuit of the liquid crystal panel. As shown in the figure, a liquid crystal panel 5 is comprised of a gate bus line 1, a data bus line 2, a TFT (Thin Film Transistor) 3, and a liquid crystal capacitance 4. The gate turn-ON signal shown in FIG. 11(A) is applied to the gate bus line 1, while the liquid crystal voltage-applying signal shown in FIG. 11(B) is applied to the data bus line 2. When these voltages are applied, the TFT 3 is brought into conduction, whereby a predetermined voltage is applied to the liquid crystal capacitance 4.

Here, a time period Tdh from a time the gate turn-ON signal has become active to a time the LCD driver starts writing image data in the liquid crystal panel 57 cannot be set to be shorter than a certain fixed time period, and hence the display device is designed such that the time period Tdh is fixed in a manner adjusted to a CLK signal having the maximum frequency that can be input. Therefore, if a CLK signal is input which has a lower frequency than the maximum frequency, the time period Tdh is made longer. Since one horizontal time period Th is fixed, if the time period Tdh is prolonged, a liquid crystal write time period is shortened accordingly. This makes it impossible to ensure a sufficient write time for writing image data in the liquid crystal panel 57.

SUMMARY OF THE INVENTION

The present invention has been made in view of these circumstances, and an object thereof is to provide a display device and method which is capable of normally displaying an image when the number of LCD drivers is not even, or when the LCD drivers have extra outputs.

To attain the above object, there is provided a display device that receives image data and displays the image data on a display block. The display device according to the invention is characterized by comprising an input circuit for receiving image data input thereto, first to N-th ($N \geqq 2$) storage circuits for storing image data input via the input circuit such that the image data is divided into respective N regions, first to M-th ($M \geqq N$) driving circuits for driving respective M regions of at least part of the display block formed by dividing the at least part of the display block, an image data supply circuit for reading out image data stored in each of the first to N-th storage circuits and supplying the image data to a corresponding one of the driving circuits, and a clock signal generation circuit for generating a clock signal for enabling image data to be read out from the first to N-th storage circuits and be supplied to the first to M-th driving circuits, in synchronism therewith.

DESCRIPTION OF THE PREFERRED EMBODIMENT

The invention will now be described in detail with reference to drawings showing a preferred embodiment thereof.

Figure 1:
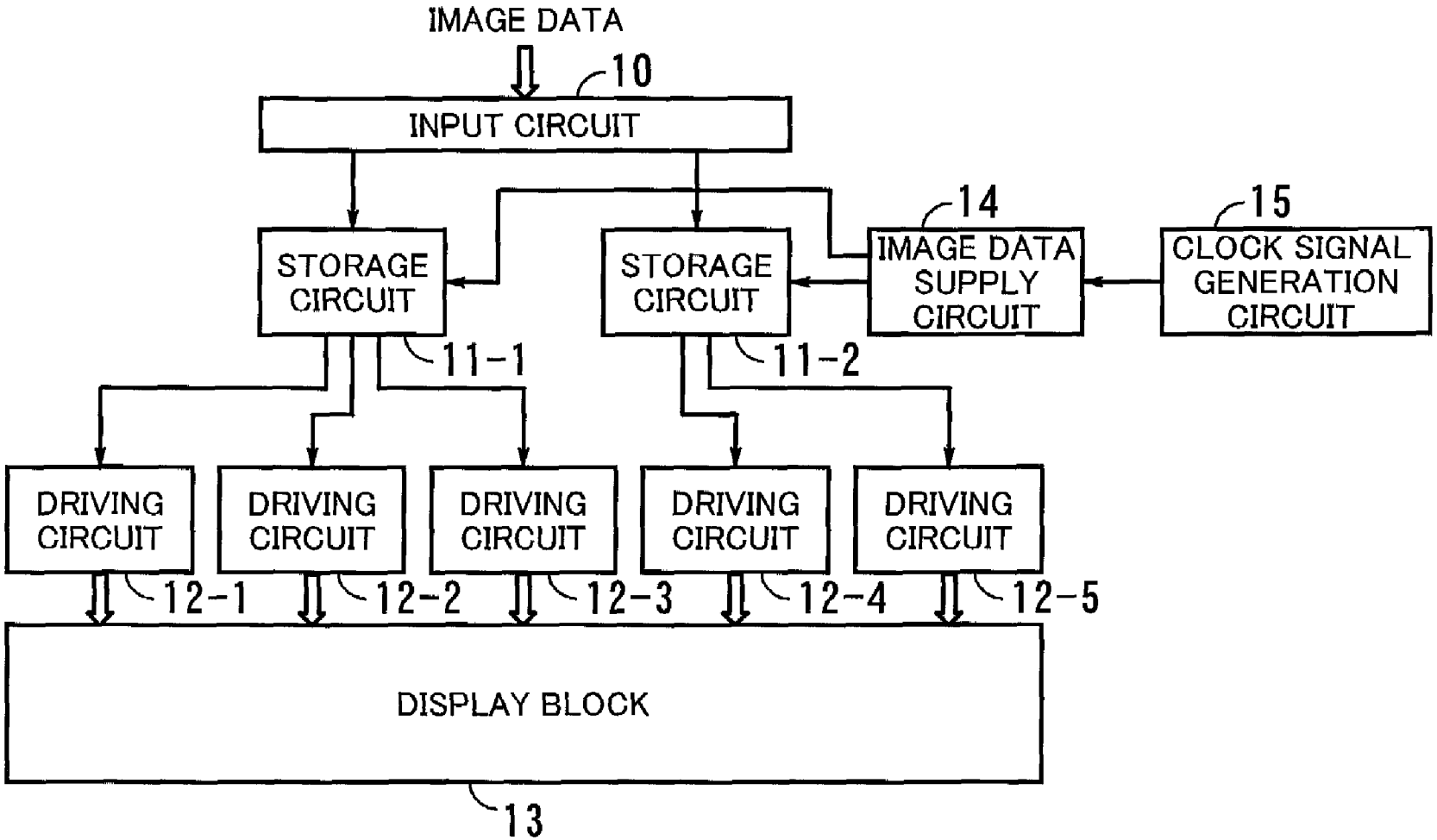
FIG. 1 is a block diagram useful in explaining the operating principles of the invention.

FIG. 1 is a block diagram showing the operating principles of the present invention. As shown in the figure, a display device according to the invention is comprised of an input circuit 10, storage circuits 11-1, 11-2, driving circuits 12-1 to 12-5, a display block 13, an image data supply circuit 14, and a clock signal generation circuit 15.

Here, the input circuit 10 receives image data input thereto.

The storage circuits 11-1, 11-2 store the image data input via the input circuit 10 such that the image data is divided into respective two portions.

The driving circuits 12-1 to 12-5 drive respective five regions of each horizontal line on the display block 13 formed by dividing the horizontal line.

The image data supply circuit 14 reads out image data from each of the storage circuits 11-1, 11-2 to supply the same to the corresponding driving circuits 12-1 to 12-5.

The clock signal generation circuit 15 generates and supplies a clock signal to the image data supply circuit 14 for allowing the same to read out image data in synchronism therewith.

Next, operations of the FIG. 1 display device will be described.

The input circuit 10 receives image data, and stores three fifths from a left end of image data forming one horizontal line, in the storage circuit 11-1, and two fifths from a right end of the same in the storage circuit 11-2. It should be noted that in the above process, image data is sequentially stored in the storage circuit 11-1 and the storage circuit 11-2 in synchronism with an external clock signal contained in the image data.

After the image data of one horizontal line has been stored in both of the storage circuit 11-1 and the storage circuit 11-2 in a divided fashion, the image data supply circuit 14 supplies image data stored in the storage circuit 11-1 to the driving circuits 12-1 to 12-3 in the mentioned order in synchronism with the clock signal supplied from the clock signal generation circuit 15. At this time, in parallel with the above supplying operation, the image data supply circuit 14 supplies image data stored in the storage circuit 11-2 to the driving circuits 12-4 to 12-5 in the mentioned order.

It should be noted that assuming that a time period required for transfer of all the image data from the storage circuit 11-1 to the driving circuits 12-1 to 12-3 is represented by Tt and the required number of pulses is represented by Pn, the frequency F of the clock signal generated by the clock signal generation circuit 15 can be represented by the following expression:

$$F \geqq Pn/Tt \tag{1}$$

It should be noted that the time period Tt is required to be set such that the relationship between the same and one horizontal time period Th satisfies the condition of $Tt<Th$.

When the frequency of the clock signal delivered from the clock signal generation circuit 15 satisfies the above expression, transfer of image data from the storage circuit 11-1 to the driving circuits 12-1 to 12-3 is terminated within one horizontal time period, and hence image data can be transferred reliably irrespective of the frequency of an external clock signal contained in the image data. Further, as to transfer of image data from the storage circuit 11-2 to the driving circuits 12-4, 12-5, it does not present any problem since the transfer is terminated in a shorter time period than that required for the transfer of image data from the storage circuit 11-1 to the driving circuits 12-1 to 12-3.

The driving circuits 12-1 to 12-3 input image data transferred from the storage circuit 11-1 to the display block 13 to thereby carry out image-drawing processing on a region of three fifths from the left end of one horizontal line on the display block 13. Further, the driving circuits 12-4, 12-5 input image data transferred from the storage circuit 11-2 to the same to carry out image-drawing processing on a region of two fifths from the right end of the one horizontal line on the display block 13.

The process described above is repeatedly carried out on a one horizontal line-by-one horizontal line basis, and when the image-drawing processing for image data of one entire frame is completed, the next frame starts to be drawn.

As described hereinabove, according to the display device of the invention, the clock signal generation circuit 15 is provided to generate and supply a clock signal having a frequency which can be set independently of a clock signal contained in image data, so that it is possible to operate the display device stably irrespective of the externally-supplied clock signal.

Although the operating principles of the invention are explained based on the display device illustrated in FIG. 1 by way of example, in which two (N=2) storage circuits and five (M=5) driving circuits are provided, it goes without saying that the invention can also be applied to a case in which $N \geqq 3$ and $M \neq 5$ hold.

Next, a preferred embodiment of the invention will be described hereinafter.

Figure 2:
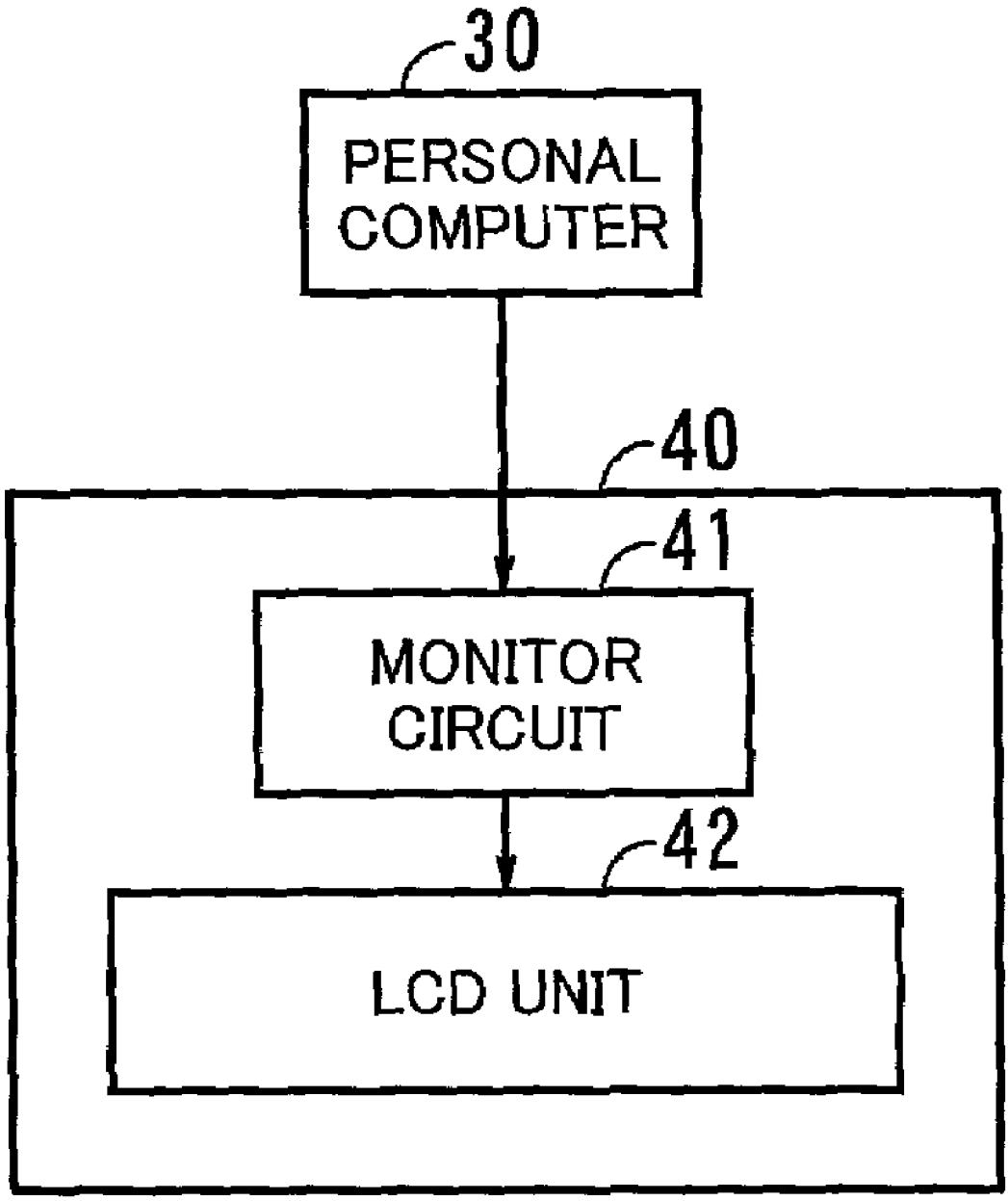
FIG. 2 is a block diagram showing an example of the construction of a display device according to an embodiment of the invention.

FIG. 2 is a diagram showing an example of the construction of a display device according to the preferred embodiment of the invention. As shown in the figure, a display device 40 according to the invention is comprised of a monitor circuit 41, and an LCD unit 42. The display device 40 receives an image signal delivered from a graphic accelerator, not shown, illustrated in a personal computer 30, and displays an image based on the signal.

Here, the personal computer 30 is comprised of a CPU (Central Processing Unit), a ROM (Read Only Memory), a RAM (Random Access Memory), an HDD (Hard Disk Drive), and the graphic accelerator, and outputs the image signal generated by the graphic accelerator according to a program stored in the HDD, to the display device 40.

The display device 40 comprised of the monitor circuit 41 and the LCD unit 42 receives the image signal delivered from the personal computer 30, and outputs the image signal to a liquid crystal panel of the LCD unit 42 to display an image based on the image signal.

Here, if the image signal delivered from the personal computer 30 and the number of pixels of the liquid crystal panel of the LCD unit 42 do not coincide with each other, the monitor circuit 41 executes a scaling process to convert the image signal as required.

As described hereinafter, the LCD unit 42 extracts a signal for a predetermined region from the image signal having been subjected to the scaling process, and then outputs the signal to the liquid crystal panel to display an image based on the signal.

Although in the present embodiment, the monitor circuit 41 and the LCD unit 42 are arranged independently of each other, this is not limitative, but they can be integrally formed as a unitary member.

Figure 3:
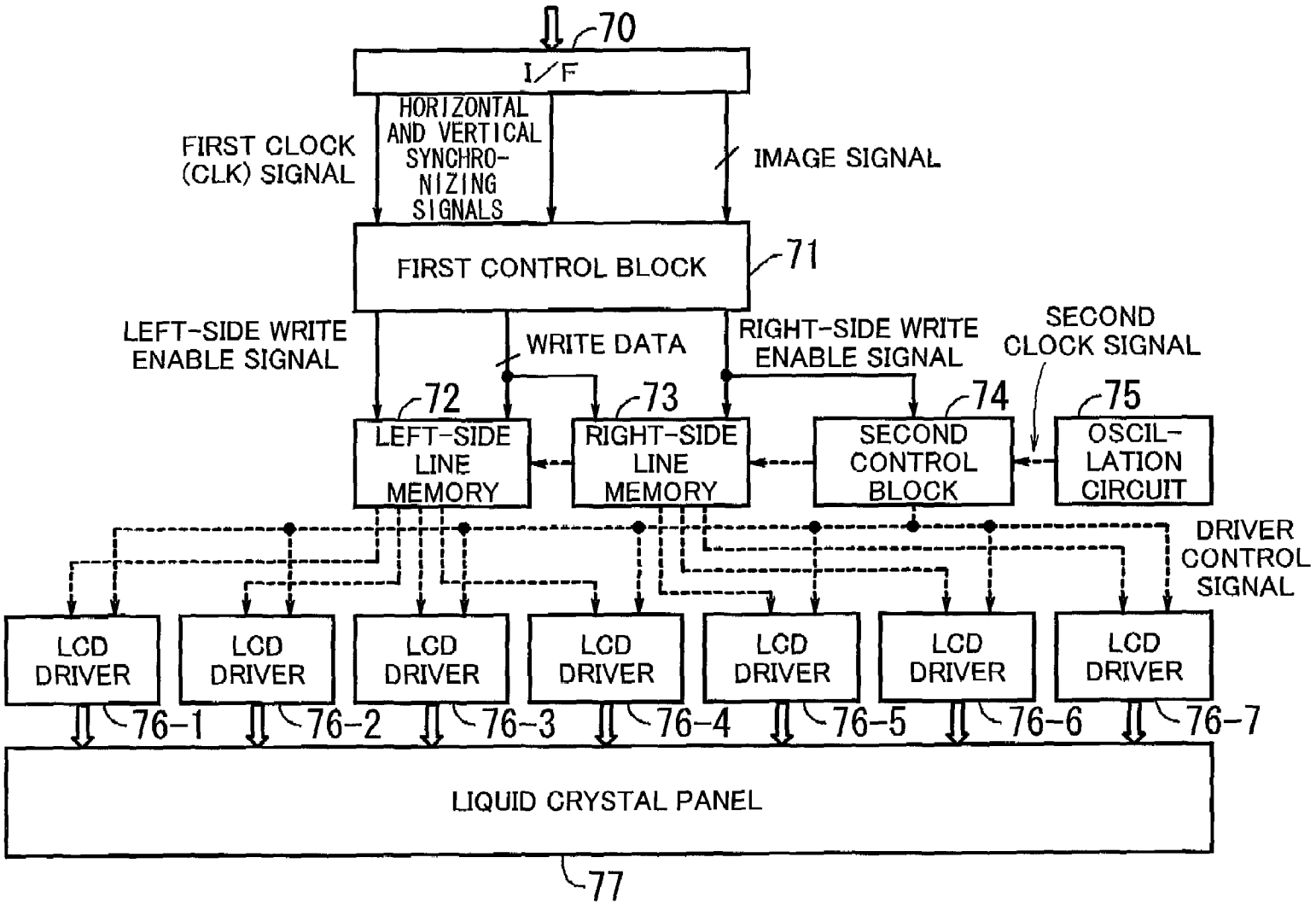
FIG. 3 is a block diagram showing details of an example of the construction of the LCD unit appearing in FIG. 2.

FIG. 3 shows details of an example of the construction of the LCD unit 42. As shown in the figure, the LCD unit 42 is comprised of an I/F 70, a first control block 71, a left-side line memory 72, a right-side line memory 73, a second control block 74, an oscillation circuit 75, LCD drivers 76-1 to 76-7, and a liquid crystal panel 77.

Here, the I/F 70 receives the input of an image signal supplied from the monitor circuit 41 to extract therefrom a first clock (CLK) signal, horizontal and vertical synchronizing signals, and an image signal, and supplies the signals to the first control block 71.

The first control block 71 generates a left-side write enable signal and a right-side write enable signal from the horizontal and vertical synchronizing signals and the first clock signal, and outputs the left-side and right-side write enable signals to the left-side line memory 72 and the right-side line memory 73, respectively.

Further, the first control block 71 supplies an image signal of one horizontal line delivered from the I/F 70, to the left-side line memory 72 when the left-side write enable signal is active, and to the right-side line memory 73 when the right-side write enable signal is active.

The left-side line memory 72 stores therein image data corresponding to a four-sevenths region from the left end of image data of one horizontal line supplied from the first control block 71, when the left-side write enable signal output from the first control block 71 is active.

The right-side line memory 73 stores therein image data corresponding to a three-sevenths region from the right end of the image data of one horizontal line supplied from the first control block 71, when the right-side write enable signal output from the first control block 71 is active.

The second control block 74 produces a synchronization reference signal, referred to hereinafter, to supply the same to the left-side line memory 72, the right-side line memory 73, and the LCD drivers 76-1 to 76-7, when the right-side write enable signal output from the first control block 71 is active.

Further, the second control block 74 reads out image data from the left-side line memory 72 in synchronism with a second clock signal supplied from the oscillation circuit 75 to sequentially deliver the image data to the LCD drivers 76-1 to 76-4, when a read enable signal, referred to hereinafter, is active.

Further, when the read enable signal is active, the second control block 74 reads out image data from the right-side line memory 73 in synchronism with the second clock signal supplied from the oscillation circuit 75 to sequentially deliver the image data to the LCD drivers 76-5 to 76-7.

The oscillation circuit 75 generates and supplies the second clock signal to the second control block 74. It should be noted that in FIG. 3, wiring indicated by broken lines shows that the involved devices are supplied with the second clock signal and operate in synchronism therewith.

Here, the frequency F of the clock signal generated by the oscillation circuit 75 is required to satisfy the above-mentioned expression (1) on condition that a time period required for transferring all the image data from the left-side line memory 72 to the LCD drivers 76-1 to 76-4 is represented by Tt and the required number of pulses is represented by Pn. Of course, the time period Tt is required to be set such that the relationship between the same and the one horizontal time period Th satisfies the condition of $Tt<Th$.

The LCD drivers 76-1 to 76-4 cause the image data supplied from the left-side line memory 72 to be displayed in the four-sevenths region from the left end of the one horizontal line on the liquid crystal panel 77.

The LCD drivers 76-5 to 76-7 cause the image data supplied from the right-side line memory 73 to be displayed in the three-sevenths region from the right end of the one horizontal line on the liquid crystal panel 77.

The liquid crystal panel 77 displays an image corresponding to image data supplied from the LCD drivers 76-1 to 76-7.

Next, the operations of the above embodiment will be described in detail with reference to timing charts shown in FIGS. 4 and 5.

When an image signal starts to be supplied from the monitor circuit 41, the I/F 70 receives the image signal, and extracts the first clock signal, the horizontal and vertical synchronizing signals, and the image signal from the same, and supplies these signals to the first control block 71.

Figure 4:
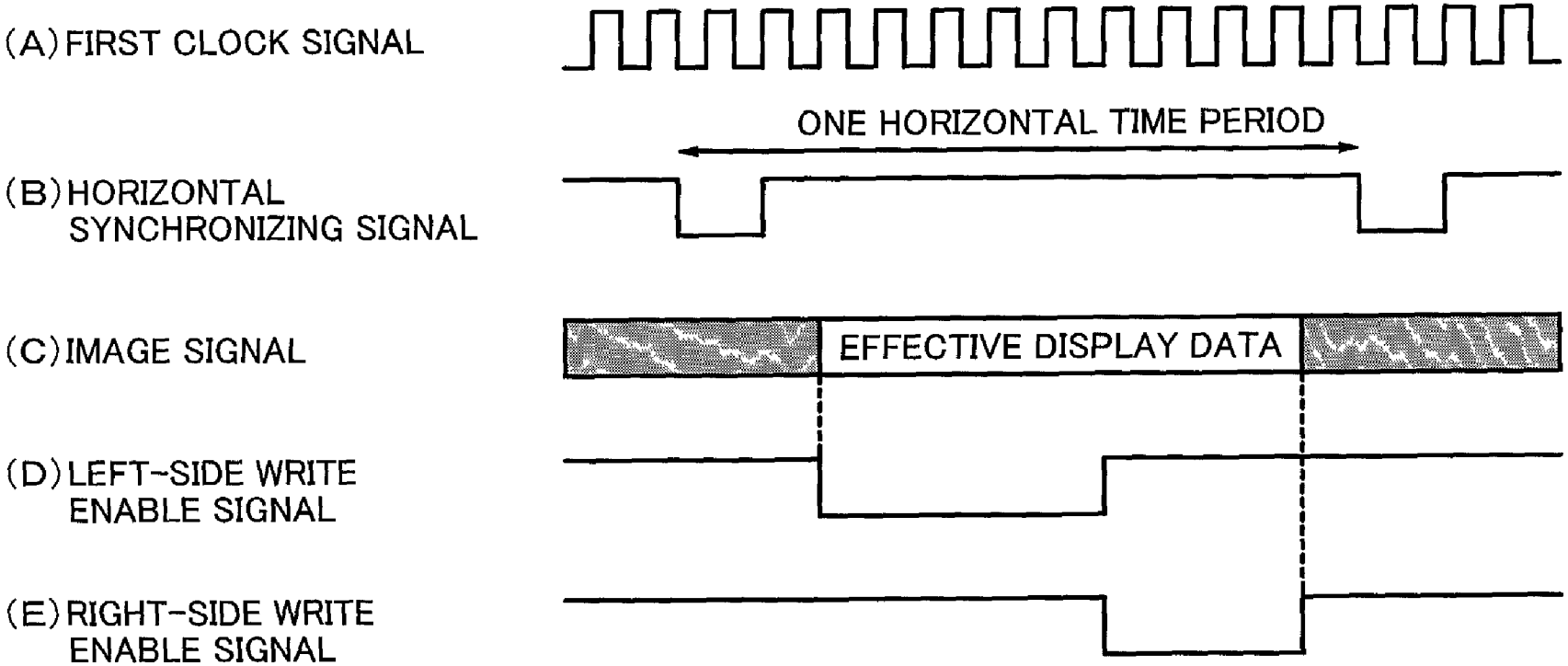
FIG. 4 is a timing chart which is useful in explaining operations of the LCD unit shown in FIG. 3.
Figure 5:
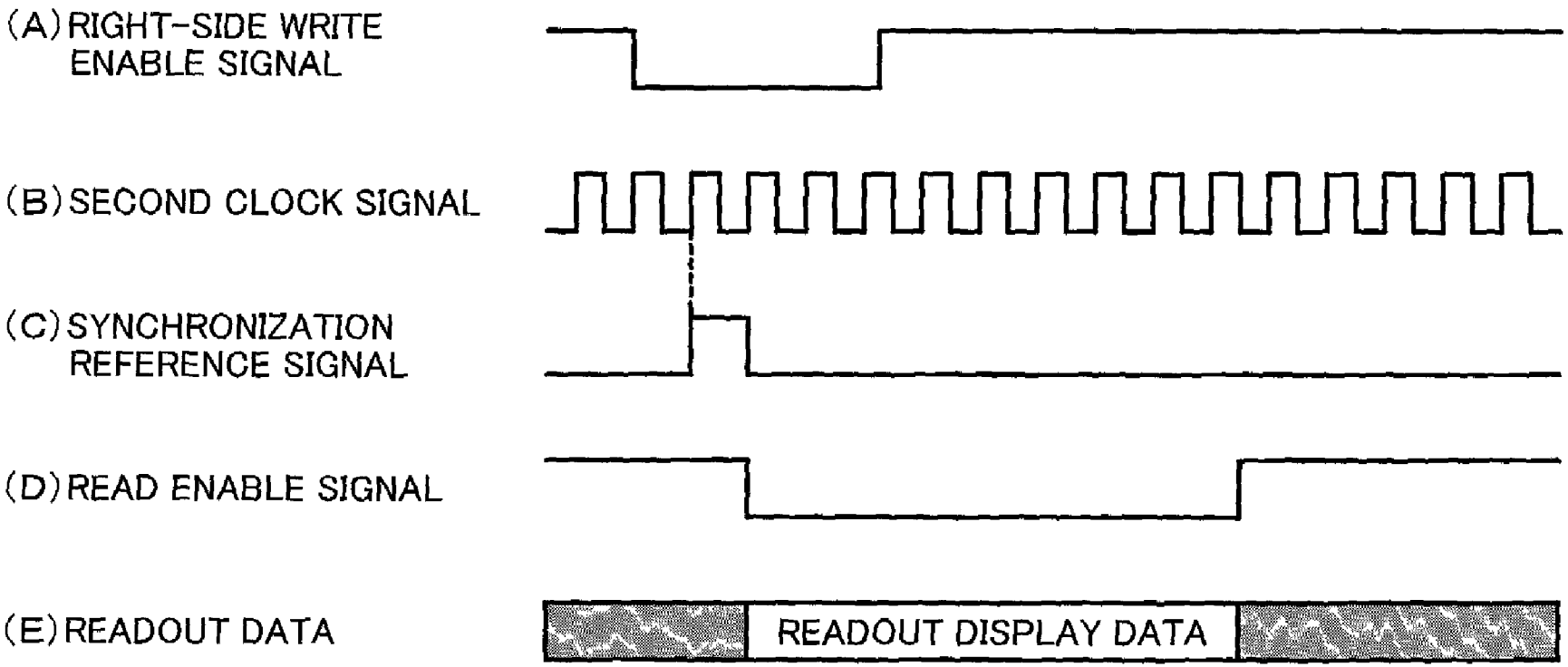
FIG. 5 is a timing chart which is useful in explaining operations of the LCD unit shown in FIG. 3.
Figure 6:
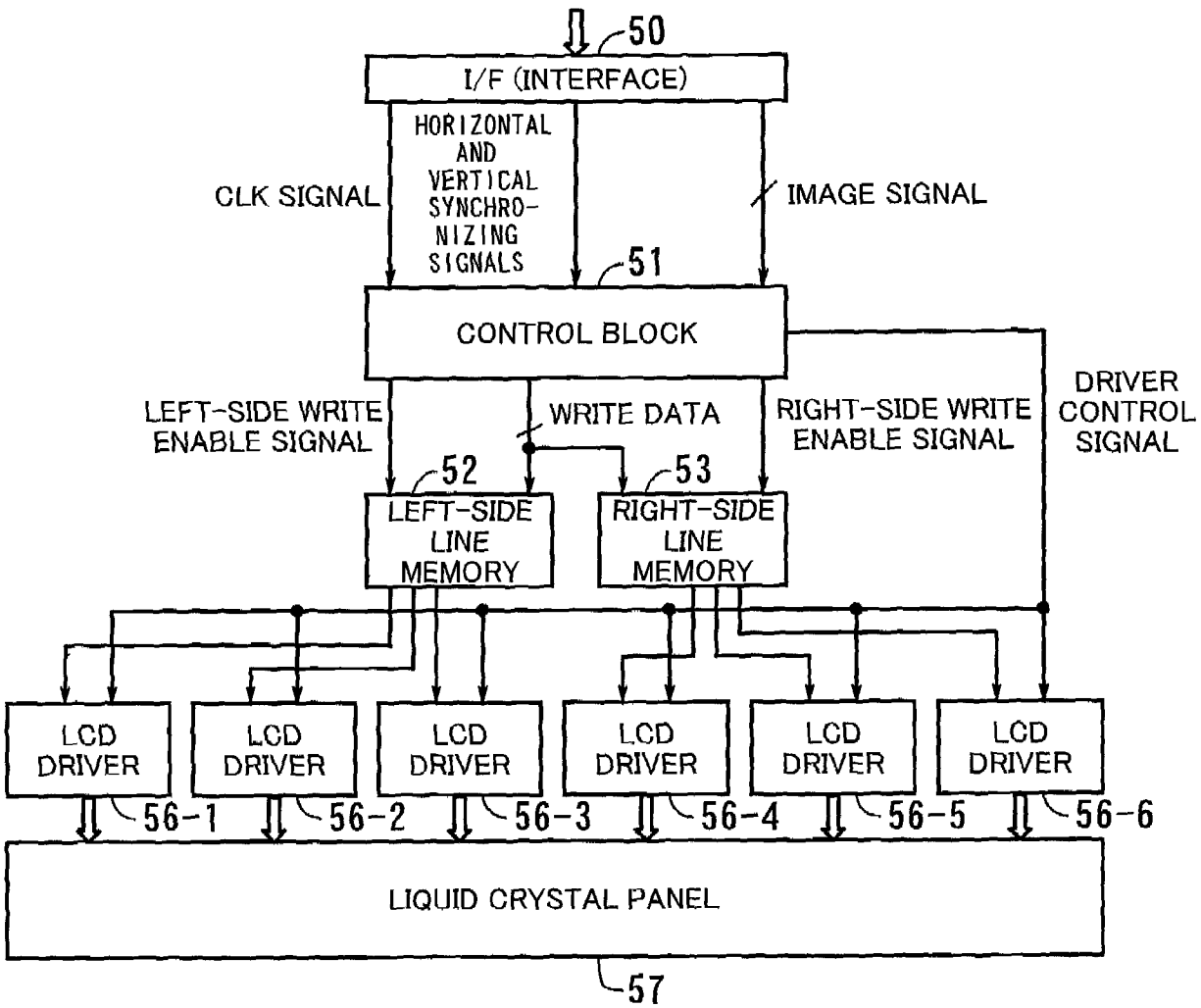
FIG. 6 PRIOR ART
FIG. 6 is a block diagram showing an example of the construction of a conventional display device.
Figure 7:
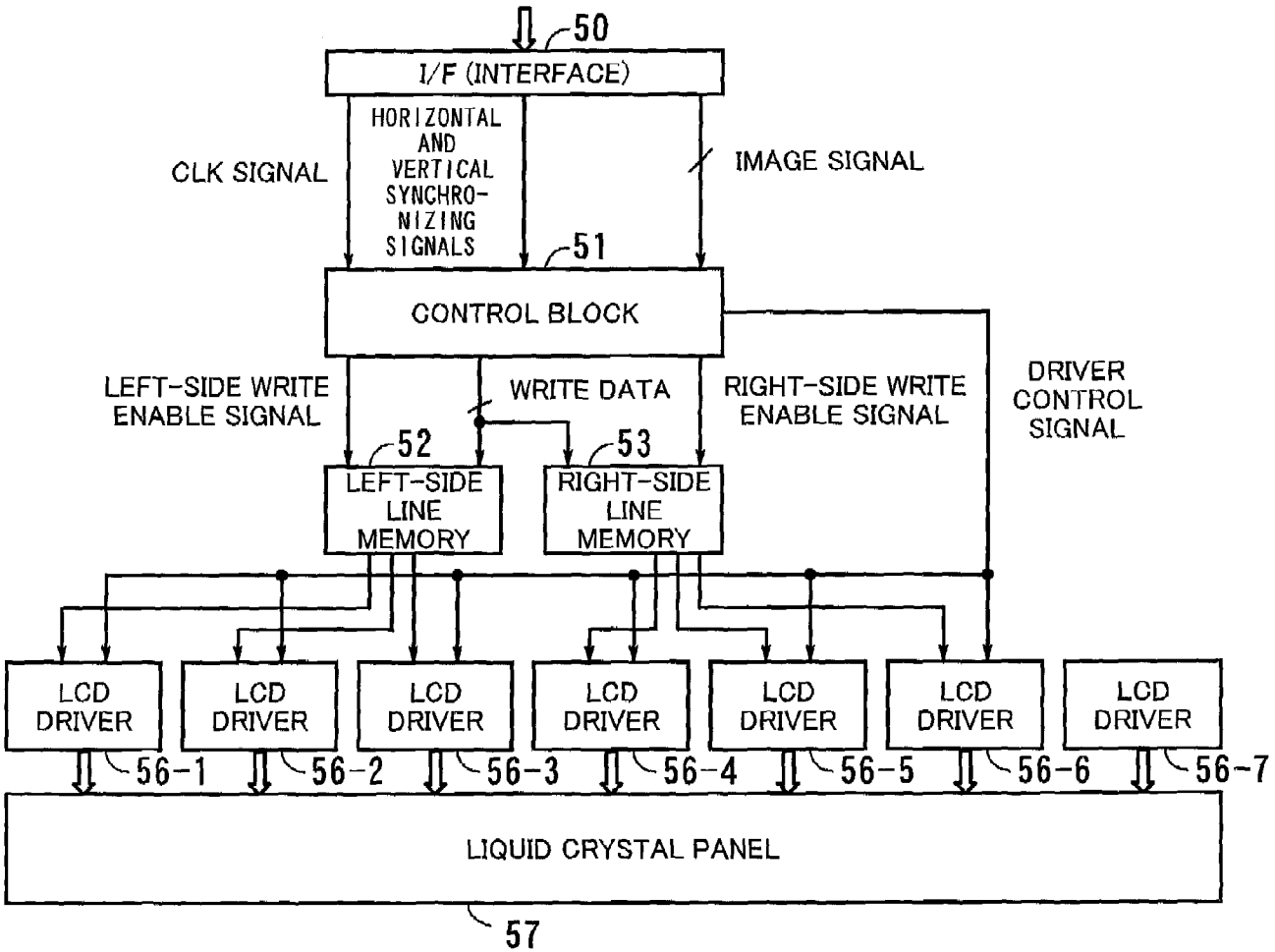
FIG. 7 PRIOR ART
FIG. 7 is a block diagram showing an example of the construction of a conventional display device which incorporates an odd number of LCD drivers.

FIG. 4 is a time chart showing the first clock signal (see FIG. 4(A)), the horizontal synchronizing signal (see FIG. 4(B)), the image signal (see FIG. 4(C)), and so forth.

The first control block 71 extracts effective display data (see FIG. 4(C)) determined according to the number of pixels of the liquid crystal panel 77, out of the image signal delivered from the I/F 70, and generates the left-side write enable signal (see FIG. 4(D)) which is a write permission signal for permitting image data to be written in the left-side line memory 72, and the right-side write enable signal (see FIG. 4(E)) which is a write permission signal for permitting image data to be written in the right-side line memory 73, to supply the left-side write enable signal and the right-side write enable signal to the left-side line memory 72 and the right-side line memory 73, respectively.

When the left-side write enable signal (see FIG. 4(D)) is active, the left-side line memory 72 reads in the image signal supplied from the first control block 71 to sequentially store image data.

On the other hand, when the right-side write enable signal (see FIG. 4(E)) is active, the right-side line memory 73 reads in the image signal supplied from the first control block 71 to sequentially store image data.

When the right-side write enable signal (see FIG. 5(A)) delivered from the first control block 71 is active, the second control block 74 detects a rising edge of the second clock signal (see FIG. 5(B)) output from the oscillation circuit 75 to generate the synchronization reference signal (see FIG. 5(C)) in synchronism with the rising edge. Further, the second control block 74 generates the read enable signal (see FIG. 5(D)) based on the synchronization reference signal, and controls the left-side line memory 72, the right-side line memory 73, and the LCD drivers 76-1 to 76-7 based on the read enable signal.

When the read enable signal (see FIG. 5(D)) is active, the left-side line memory 72 reads out image data, as shown in FIG. 5(E), and sequentially transfers the same to the LCD drivers 76-1 to 76-4.

Similarly, when the read enable signal (see FIG. 5(D)) is active, the right-side line memory 73 as well reads out image data, as shown in FIG. 5(E), to sequentially transfer the same to the LCD drivers 76-5 to 76-7.

Now, since the read enable signal (see FIG. 5(D)) is generated by counting pulses of the second clock signal delivered from the oscillation circuit 75, it is made active only for a time period required for transferring image data from the left-side line memory 72 to the LCD drivers 76-1 to 76-4, irrespective of the frequency of the first clock signal. Therefore, by transferring data with reference to the read enable signal, it is possible to reliably transfer image data from the left-side line memory 72 and the right-side line memory 73 to the LCD drivers 76-1 to 76-4 and LCD drivers 76-5 to 76-7, respectively.

After the transfer of image data has been completed, the second control block 74 sends a control signal to the LCD driver 76-1. Responsive to the control signal, the LCD driver 76-1 displays image data supplied from the left-side line memory 72 on the liquid crystal panel 77 sequentially from the left end of a predetermined horizontal line thereof.

When the LCD driver 76-1 has displayed all the image data on the liquid crystal panel 77, then, similarly, the LCD driver 76-2 displays image data, and thereafter the LCD drivers 76-3 to 76-7 display image data on the liquid crystal panel 77 in the mentioned order.

The above processing is repeatedly carried out on each horizontal line, and after display of image data on all the horizontal lines has been completed, processing for displaying the next frame is carried out.

As described hereinabove, according to the present embodiment of the invention, the oscillation circuit 75 that is capable of generating the second clock signal independent of the first clock signal delivered together with image data from the outside is provided so as to allow image data to be transferred from the left-side line memory 72 and the right-side line memory 73 to the LCD drivers 76-1 to 76-7 in synchronism with the second clock signal. This make it possible to transfer image data in a suitable timing irrespective of the first clock signal.

More specifically, when one horizontal time period is represented by Th, if the number of pulses of the first clock signal during the one horizontal time period is N1, and the frequency of the first clock signal is F1, while the number of pulses of the second clock signal during the one horizontal time period is N2, and the frequency of the second clock signal is F2, the display device can be normally operated so long as $Th \geqq N2/F2$ holds, even if $N1<N2$. Therefore, by setting the second clock signal suitably, it is possible to secure the optimum operation of the display device irrespective of the frequency of the first clock signal.

Figure 8:
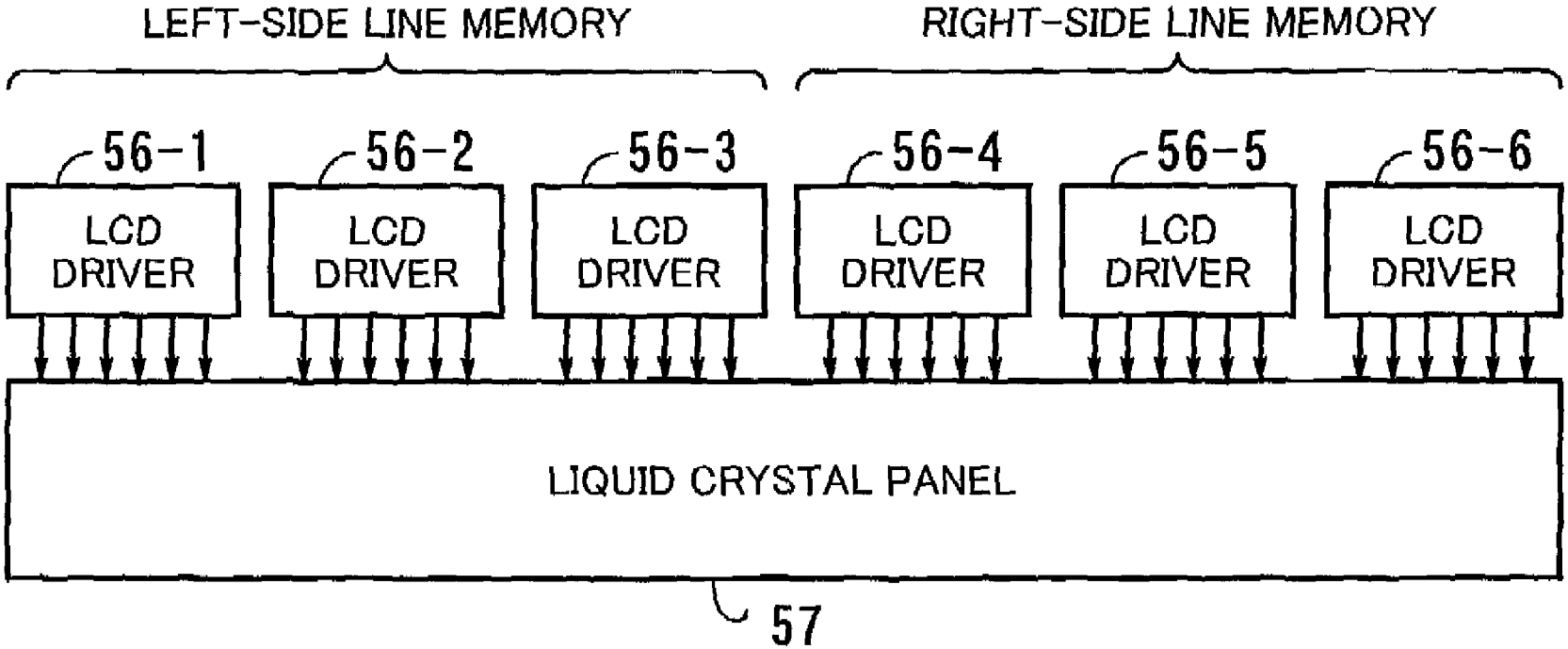
FIG. 8 PRIOR ART
FIG. 8 is a block diagram showing an example of the construction of a display device which incorporates an even number of LCD drivers.
Figure 9:
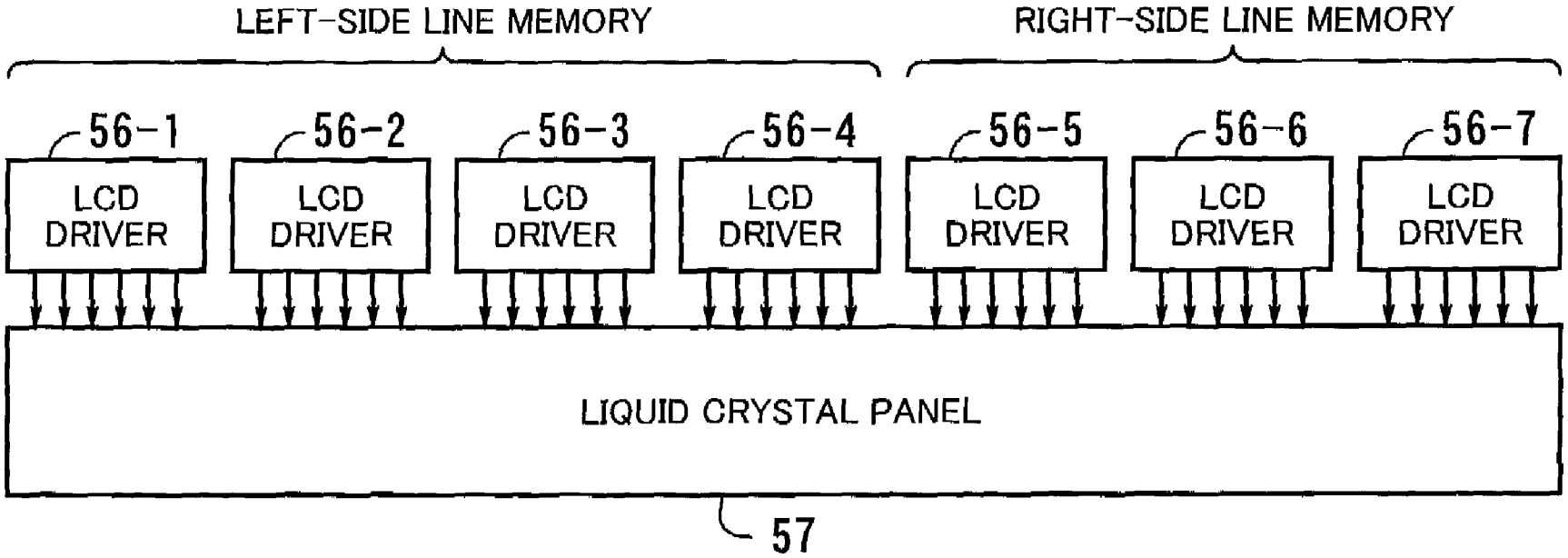
FIG. 9 PRIOR ART
FIG. 9 is a block diagram showing an example of the construction of a display device which incorporates an odd number of LCD drivers.
Figure 11:
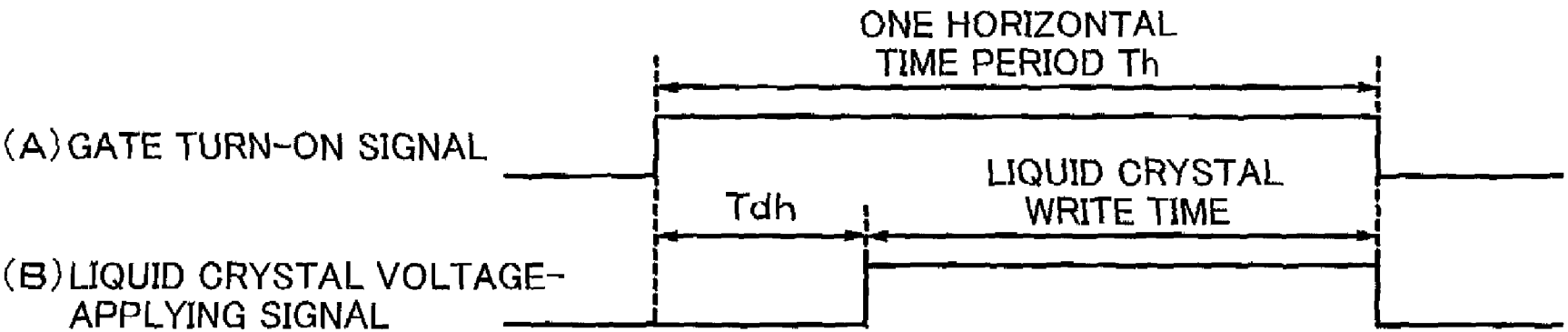
FIG. 11 PRIOR ART
FIG. 11 is a timing chart showing the relationship between a gate turn-ON signal and a liquid crystal voltage-applying signal.
Figure 12:
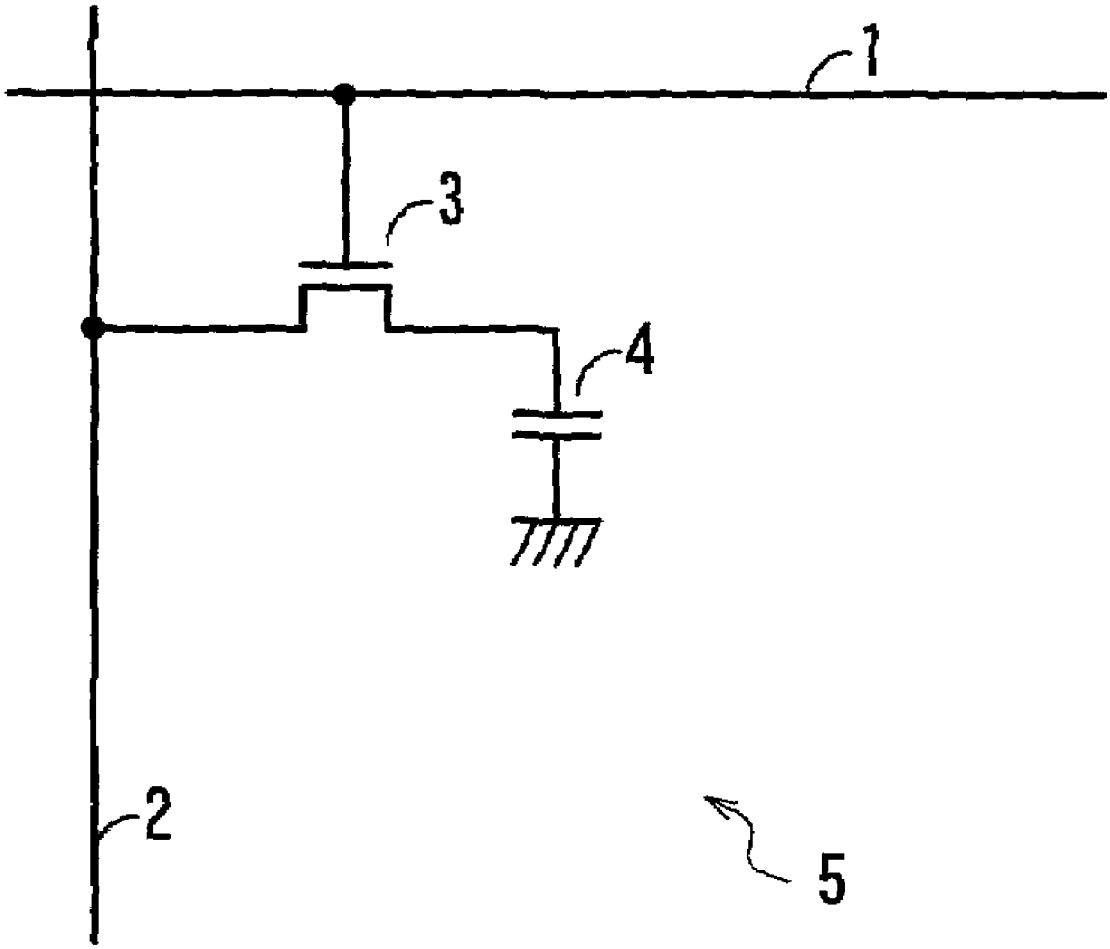
FIG. 12 PRIOR ART
FIG. 12 is a diagram showing an equivalent circuit of a liquid crystal panel.

Although in the above embodiment, the description has been given by way of example based on the case of the odd number of LCD drivers 76-1 to 76-7 being provided, this is not limitative but as shown in FIG. 8, it is possible to apply the invention to a case in which an even number of LCD drivers are provided and the LCD drivers have no extra outputs. If the invention is applied to such a case, the time period Tdh appearing in FIG. 11 is constant irrespective of the first clock signal, which makes it possible to ensure a sufficient write time for writing data into the liquid crystal panel.

Figure 10:
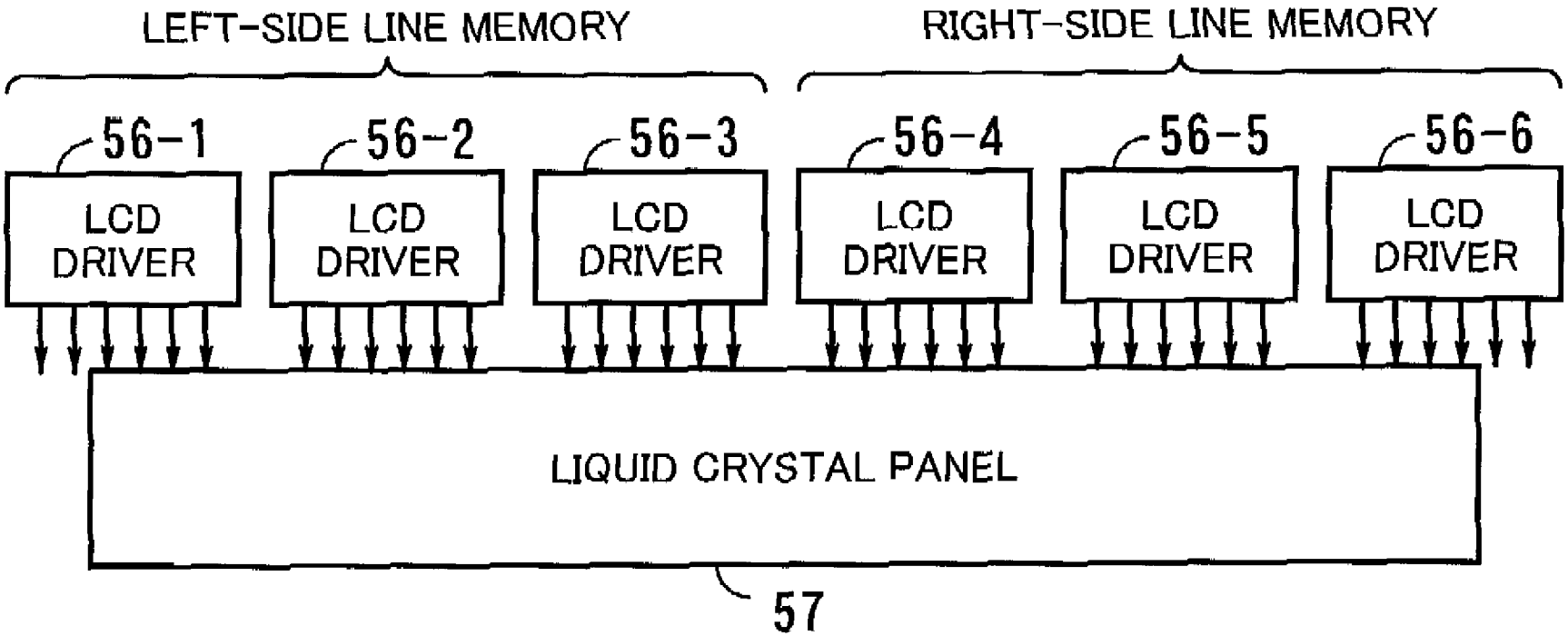
FIG. 10 PRIOR ART
FIG. 10 is a block diagram showing an example of the construction of a display device in which LCD drivers have extra outputs.

It goes without saying that as shown in FIG. 10, the invention can also be applied to a case in which the LCD drivers have extra outputs. If the invention is applied to such a case, the second clock signal is set in view of the extra outputs of the LCD drivers, whereby it is possible to realize a stable operation of the display device.

Although in the above embodiment, description has been given assuming the use of an LCD formed by combining a driver IC (externally attached) with an a-Si TFT panel which uses amorphous silicon (a-Si) in the operation layer of a TFT (thin film transistor), this is not limitative, but needless to say, the invention can be applied to a p-Si TFT panel which uses polycrystalline silicon (p-Si) in the TFT operation layer and incorporates even a peripheral circuit (driver circuit) on the same circuit board.

As described hereinbefore, according to the present invention, in a display device that receives image data and displays the image data on a display block, the display device is characterized by comprising an input circuit for receiving image data input thereto, first to N-th ($N \geqq 2$)

storage circuits for storing image data input via the input circuit such that the image data is divided into respective N regions, first to M-th (M≧N) driving circuits for driving respective M regions of at least part of the display block formed by dividing the at least part of the display block, an image data supply circuit for reading out image data stored in each of the first to N-th storage circuits and supplying the image data to a corresponding one of the driving circuits, and a clock signal generation circuit for generating a clock signal for enabling image data to be read out from the first to N-th storage circuits and be supplied to the first to M-th driving circuits, in synchronism therewith. Therefore, it is possible to stabilize the operation of the display device irrespective of the number of driving circuits and an external clock signal.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A display device that receives image data and displays the image data on a display block which is a display panel, the display device comprising:

an input circuit for receiving image data input thereto;

first to N-th (N≧2) storage circuits which are line memories for storing image data input via said input circuit, based on a first clock signal, such that the image data is divided into respective N regions;

first to M-th (M≧N) driving circuits which are display drivers for driving respective M regions of at least part of the display block formed by dividing the at least part of the display block;

an image data supply circuit for reading out image data stored in each of said first to N-th storage circuits and supplying the image data to a corresponding one of said driving circuits;

a clock signal generation circuit for generating a second clock signal;

a synchronization reference signal generated by said image data supply circuit based on said second clock signal; and a read enable signal, which is generated by said image data supply circuit based on said synchronization reference signal, for enabling image data to be read out from said first to N-th storage circuits and be supplied to said first to M-th driving circuits, in synchronism therewith, wherein the second clock signal generated by said clock signal generation circuit has a frequency F satisfying:

$F \geqq Pn/Tt$ and $Tt < Th$, provided that:

Cn is the number of the m-th driving circuit which receives image data transferred by a n-th storage circuit (1≦m≦M, 1≦n≦N), nx is a n where Cn is maximum;

Pn is the number of pulses required for transfer of image data from the nx-th storage circuit to the corresponding driving circuit;

Tt is a time period required for transfer of image data from the nx-th storage circuit to the corresponding driving circuit; and Th is one horizontal time period.

2. The display device according to claim 1, wherein said first to N-th storage circuits store image data of one horizontal line divided into the N regions, respectively.

3. The display device according to claim 1, wherein said first to N-th storage circuits store the image data in synchronism with an external clock signal.

4. The display device according to claim 3, wherein the image data supply circuit generates a control signal required for supplying image data to said first to M-th driving circuits, with reference to a predetermined timing in which the image data is written in said first to N-th storage circuits.

5. A display method of receiving image data and displaying the image data on a display block which is a display panel, the method comprising:

an inputting step of receiving image data input thereto;

first to N-th (N≧2) storing steps of storing, in a line memory, image data input in the inputting step, based on a first clock signal, such that the image data is divided into respective N regions;

first to M-th (M≧N) driving steps of driving, in a display driver, respective M regions of at least part of the display block formed by dividing the at least part of the displaying block;

an image data supplying step of reading out image data stored in each of the first to N-th storing steps and supplying the image data to a corresponding one of the driving steps; and a clock signal generating step of generating a second clock signal, wherein said image data supplying step further includes a step of generating a synchronization reference signal based on said second clock signal, wherein said image data supplying step further includes a step of generating a read enable signal, based on said synchronization reference signal, for enabling image data to be read out from the first to N-th storing steps and be supplied to the first to M-th driving steps, in synchronism therewith, wherein the second clock signal has a frequency F satisfying:

$F \geqq Pn/Tt$ and $Tt < Th$, provided that:

Cn is the number of the m-th driving step which receives image data transferred by an n-th storage step (1≦m≦M, 1≦n≦N), nx is a n where Cn is maximum;

Pn is the number of pulses required for transfer of image data from the nx-th storage step to the corresponding driving step;

Tt is a time period required for transfer of image data from the nx-th storage step to the corresponding driving step; and Th is one horizontal time period.

6. The display device according to claim 1, wherein the first clock signal is an external clock signal and the second clock signal has a frequency that is other than equal to or one-half of a frequency of the first clock signal.

7. The display method according to claim 5, wherein the first clock signal is an external clock signal and the second clock signal has a frequency that is other than equal to or one-half of a frequency of the first clock signal.

8. A display device that receives image data and displays the image data on a display block which is a display panel, the display device comprising:

an input circuit for receiving image data input thereto; first to N-th (N≧2) storage circuits which are line memories for storing image data input via said input circuit, based on a first clock signal, such that the image data is divided into respective N regions;

first to M-th (M≧N) driving circuits which are display drivers for driving respective M regions of at least part of the display block formed by dividing the at least part of the display block, wherein M is an odd number;

said driving circuits further including a plurality of outputs connected to said display block;

an image data supply circuit for reading out image data stored in each of said first to N-th storage circuits and supplying the image data to a corresponding one of said driving circuits; and a clock signal generation circuit for generating a second clock signal;

a synchronization reference signal generated by said image data supply circuit based on said second clock signal; and a read enable signal, which is generated by said image data supply circuit based on said synchronization reference signal, for enabling image data to be read out from said first to N-th storage circuits and be supplied to said first to M-th driving circuits, in synchronism therewith, wherein the second clock signal generated by said clock signal generation circuit has a count of pulses no more than the number of the plurality of outputs of said driving circuits and a frequency F satisfying:

$$F \geqq Pn/Tt \text{ and}$$

$$Tt < Th,$$

provided that:

Cn is the number of the m-th driving circuit which receives image data transferred by a n-th storage circuit (1≦m≦M, 1≦n≦N), nx is a n where Cn is maximum;

Pn is the number of pulses required for transfer of image data from the nx-th storage circuit to the corresponding driving circuit;

Tt is a time period required for transfer of image data from the nx-th storage circuit to the corresponding driving circuit; and Th is one horizontal time period.

9. The display device according to claim 8, wherein the first clock signal is an external clock signal and the second clock signal has a frequency that is other than equal to or one-half of a frequency of the first clock signal.

10. The display device according to claim 8, wherein said first to N-th storage circuits store image data of one horizontal line divided into the N regions, respectively.

11. The display device according to claim 8, wherein said first to N-th storage circuits store the image data in synchronism with an external clock signal.

12. The display device according to claim 11, wherein the image data supply circuit generates a control signal required for supplying image data to said first to M-th driving circuits, with reference to a predetermined timing in which the image data is written in said first to N-th storage circuits.

13. The display device according to claim 1, wherein said input circuit generates a right-side write enable signal from the image data and supplies said right-side write enable signal to said image data supply circuit.

14. The display device according to claim 13, wherein said image data supply circuit generates said synchronization reference signal when a rising edge of said second clock signal is received by said image data supply circuit and said right-side write enable signal is active.

15. The display method according to claim 5, wherein said inputting step further includes the steps of:

generating a right-side write enable signal from the image data; and supplying said right-side write enable signal to said image data supplying step for processing.

16. The display method according to claim 15, wherein said image data supplying step further includes the step of:

generating said synchronization reference signal when a rising edge of said second clock signal is received by said image data supply circuit and said right-side write enable signal is active.

17. The display device according to claim 8, wherein said input circuit generates a right-side write enable signal from the image data and supplies said right-side write enable signal to said image data supply circuit.

18. The display device according to claim 17, wherein said image data supply circuit generates said synchronization reference signal when a rising edge of said second clock signal is received by said image data supply circuit and said right-side write enable signal is active.

19. The display device according to claim 1, wherein N=2, M=5, C1=3, C2=2 and nx=1.

20. The display method according to claim 5, wherein N=2, M=5, C1=3, C2=2 and nx=1.

21. The display device according to claim 8, wherein N=2, M=5, C1=3, C2=2 and nx=1.

22. The display device according to claim 1, wherein N=2, M=7, C1=4, C2=3 and nx=1.

23. The display method according to claim 5, wherein N=2, M=7, C1=4, C2=3 and nx=1.

24. The display device according to claim 8, wherein N=2, M=7, C1=4, C2=3 and nx=1.

25. The display device according to claim 1, wherein the second clock signal generated by said clock signal generation circuit has a frequency determined according to a maximum time period required for the image data supply circuit to transfer image data from said first to N-th storage circuits to said first to M-th driving circuits and a count of pulses required for transferring the image data.

26. The display method according to claim 5, wherein the second clock signal generated by said clock signal generation circuit has a frequency determined according to a maximum time period required for the image data supply circuit to transfer image data from said first to N-th storage circuits to said first to M-th driving circuits and a count of pulses required for transferring the image data.

27. The display device according to claim 1, wherein:

the display driver is an LCD driver; and the display panel is a liquid crystal panel.

28. The display method according to claim 5, wherein:

the display driver is an LCD driver; and the display panel is a liquid crystal panel.

29. A display device according to claim 8, wherein:

a display device receives image data and displays the image data on a display block which is a display panel, the display device comprising:

an input circuit for receiving image data input thereto;

first to N-th (N≧2) storage circuits which are line memories for storing image data input via said input circuit, based on a first clock signal, such that the image data is divided into respective N regions;

first to M-th (M≧N) driving circuits which are display drivers for driving respective M regions of at least part of the display block formed by dividing the at least part of the display block;

an image data supply circuit for reading out image data stored in each of said first to N-th storage circuits and supplying the image data to a corresponding one of said driving circuits;

a clock signal generation circuit for generating a second clock signal;

a synchronization reference signal generated by said image data supply circuit based on said second clock signal; and a read enable signal, which is generated by said image data supply circuit based on said synchronization reference signal, for enabling image data to be read out from said first to N-th storage circuits and be supplied to said first to M-th driving circuits, in synchronism therewith, wherein the second clock signal generated by said clock signal generation circuit has a frequency F satisfying:

$$F \geqq Pn/Tt \text{ and}$$

$$Tt < Th,$$

provided that:

Cn is the number of the m-th driving circuit which receives image data transferred by a n-th storage circuit (1≦m≦M, 1≦n≦N), nx is a n where Cn is maximum;

Pn is the number of pulses required for transfer of image data from the nx-th storage circuit to the corresponding driving circuit;

Tt is a time period required for transfer of image data from the nx-th storage circuit to the corresponding driving circuit; and Th is one horizontal time period.

30. The display device according to claim 8, wherein the display driver is an LCD driver; and the display panel is a liquid crystal panel.

* * * * *